United States Patent [19]

Hartung

[11] 4,174,784

[45] Nov. 20, 1979

[54] ANTI-COLLAPSE CAP

[76] Inventor: Philip F. Hartung, 655 Main St., East Greenwich, R.I. 02818

[21] Appl. No.: 848,436

[22] Filed: Nov. 4, 1977

Related U.S. Application Data

[63] Continuation-in-part of Ser. No. 742,492, Nov. 17, 1976, abandoned.

[51] Int. Cl.[2] ..... B65D 53/00

[52] U.S. Cl. ..... 215/349; 215/341; 215/260; 215/271

[58] Field of Search ..... 215/1 C, 260, 270, 271, 215/341, 349

[56] References Cited

U.S. PATENT DOCUMENTS

| | | | |
|---|---|---|---|
| 2,034,739 | 3/1936 | Bodor | 215/271 |
| 2,040,798 | 5/1936 | Schoonmaker | 215/271 |
| 2,319,849 | 5/1943 | Crabbe | 215/260 |
| 2,424,801 | 7/1947 | Crabbe | 215/260 |
| 2,449,014 | 9/1948 | Shaffer | 215/260 |
| 2,723,041 | 11/1955 | Hart-Still | 215/270 |
| 2,986,297 | 5/1961 | Pollick | 215/271 |
| 3,022,918 | 2/1962 | Smith | 215/260 |
| 3,189,210 | 6/1965 | Heisler | 215/260 |
| 3,308,981 | 3/1967 | Starr | 215/260 |

FOREIGN PATENT DOCUMENTS

| | | | |
|---|---|---|---|
| 605916 | 6/1926 | France | 215/270 |
| 1138982 | 6/1957 | France | 215/271 |
| 97265 | 10/1939 | Sweden | 215/271 |

*Primary Examiner*—Ro E. Hart

*Attorney, Agent, or Firm*—Geoffrey R. Myers

[57] ABSTRACT

Provided is a device for preventing the inward deformation of a hollow plastic container which would normally inwardly deform after closure due to the cooling of hot liquids therein. The device comprises a membrane extending across the container spout for sealing the spout, which membrane is more flexible than the walls of the container, means for securing the membrane into sealing engagement with the spout, and means for applying the ambient pressure existing on the outside of the container to the outside of the surface of the membrane.

6 Claims, 13 Drawing Figures

ANTI-COLLAPSE CAP

CROSS-REFERENCE TO RELATED APPLICATION

This application is a continuation-in-part of my copending application, Ser. No. 742,492 filed Nov. 17, 1976 and now abandoned.

This application relates to closure devices or caps. More particularly, it relates to expandable sealing means for flexible plastic or other types of containers which have the tendency to inwardly deform when, after sealing, there is a pressure reduction within the container.

A significant problem in the commercial products industry has been the problem of inward deformation, sometimes to the extent of implosion, of plastic or other thin walled containers (e.g., bottles) caused by a reduction in internal pressure after the container is filled and hermetically sealed. A typical example is that of vegetable oil or cranberry juice bottles or other containers which are filled with initially hot fluids that cool down after the container is sealed.

Such containers are most inexpensively produced in mass volume by blow molding techniques which minimize costs by maintaining the walls of the container as thin as possible, while, at the same time, achieving rigidity. Such walls are, therefore, relatively flexible and, thus, susceptible to implosion or inward deformation if there is an internal change or lowering of pressure in the container after the spout orifice is sealed.

It is the purpose of this invention to solve the above described problem in the industry by providing a unique device for preventing the inward deformation of a hollow, orificed container having relatively flexible thin walls, after the container is filled and sealed, the device comprising, generally, a membrane means for sealing the orifice of the container which is more flexible than the walls of the container, means for securing the membrane means into sealing engagement with the orifice, and means for applying the ambient pressure on the outside surface of the walls of the container to the outside surface of the membrane.

While this invention is applicable to a wide variety of containers having relatively thin flexible walls that tend to inwardly deform or implode when there is an internal pressure change therewithin after sealing of the orifice spout, it is most applicable to plastic containers of relatively thin walls which transport fluids initially placed in them as hot but which cool after the container is sealed. In such instances, the devices of this invention comprise a unique cap and closure means for these plastic bottles which is relatively inexpensive, simple and yet effective for its intended purpose.

While it has been known to provide caps which expand or flex during operation, such have been used for different purposes and are of generally different construction in the sense that they are meant for containers that do not have a tendency to inwardly deform. For example, these caps have usually been used for various purposes, such as to control the internal mechanism of a rigid bottle whose walls do not have a tendency to implode or inwardly deform. Exemplary of such closure devices can be found in U.S. Pat. Nos.:

1,978,635
2,316,453
2,880,900

3,088,616
3,248,302
3,371,814
3,580,409

This invention will now be described with respect to certain embodiments thereof, as illustrated in the accompanying drawings, wherein:

IN THE DRAWINGS

FIGS. 4 thru 11 are side sectional views of separate embodiments of other membranes as contemplated by this invention.

Figure 12:
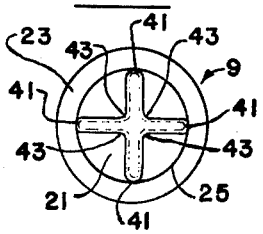

FIG. 12 is a bottom plan view of another embodiment of a membrane in accordance with this invention.

Figure 13:
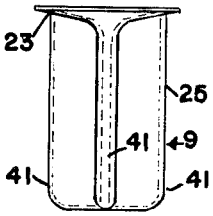

FIG. 13 is a side plan view of the membrane of FIG. 12.

Figure 1:
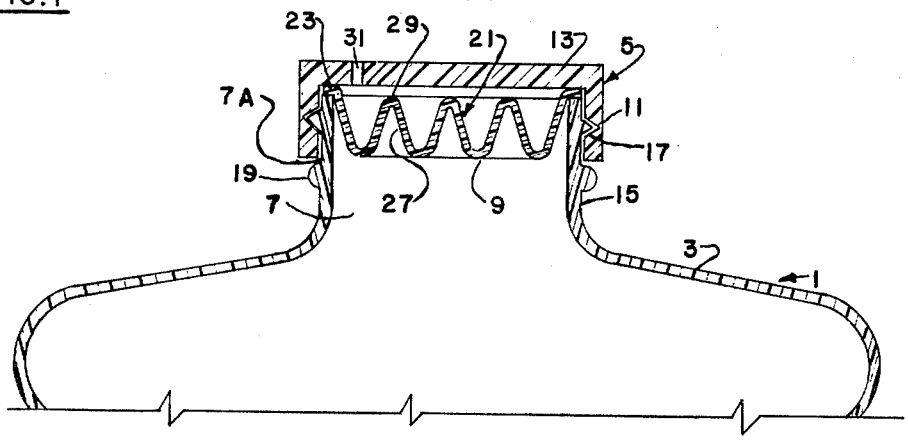
FIG. 1 is a side sectional view of a container in combination with one embodiment of a device in accordance with this invention.

Referring now to FIG. 1, there is illustrated the upper section of a plastic hollow container 1 having relatively thin walls 3. Walls 3 of container 1 are usually formed in a blow molding process of a thermoplastic material, such as polyethylene, polypropylene, polyvinylchloride, acrylates generally, polycarbonates generally, acrylonitriles, or the like. As such, these walls, generally on the order of approximately 0.02–0.04 inches in thickness, are sufficiently rigid so that the bottle stands of its own without support, and are sufficiently impermeable so as to contain the material desired (foodstuffs and the like). On the other hand, because of the nature of the material employed and its thinness, such bottles are subject to inward deformation if, after sealing them, there is a decrease in internal pressure which is unaccompanied by an equivalent decrease in pressure external to the bottle.

In order to prevent and/or limit inward deformation of the walls to any substantial degree, and particularly to prevent implosion, there is provided a unique device 5 for closing the spout neck orifice 7 of bottle 1. Device 5 generally comprises a membrane or diaphragm 9 and a cap means 11 for sealing or securing the membrane 9 within spout orifice 7.

Cap means 11 may be of any conventional configuration, such as threaded, snap fit, or fused. As illustrated, cap 11 comprises circumferential cap walls 13 which are secured to the spout neck wall 15 by way of a conventional screw thread 17. Screw thread 17 terminates in stop bead 19, extending circumferentially about spout neck 7*a*.

Membrane 9 is generally formed of a single unitary piece of flexible material, which has a degree of flexibility greater than the degree of flexibility of walls 3, such that membrane 9 will deform before walls 3 when there is a reduction in pressure in container 1. Membrane 9 in this respect is comprised of two portions. The first, or internal portion, is flexible portion 21. The second, or circumferential, portion is flange means 23. As can be seen, flexible portion 21 exists within the confines of orifice 7, while flange 23 resides on the upper surface of the spout walls 15 and is brought into contact therewith by cap 11, such that as cap 11 is screwed down tightly onto its screw threads 17, flange 23 is pressed against spout neck walls 15, sealing orifice 7 hermetically.

In the embodiments illustrated in FIGS. 1–11, membrane or diaphragm 9 is comprised of an initially downwardly extending wall 25 which thereafter proceeds upwardly so as to define an elevated portion 27. Elevated portion 27 may define a single or plurality of peaks 29. Preferably, the upper horizontal plane of peak 28 does not extend above the lower horizontal plane of flange 23. This is to insure proper sealing of the orifice spout as the cap is twisted down onto its screw threads.

The membrane or diaphragm 9 illustrated in FIGS. 12–13 is different in that its peaks and valleys are radial rather than lateral as in FIGS. 1–11. In this respect, membrane 9 of FIGS. 12–13 includes a downwardly extending wall 25 and a radial star design consisting of points (or valleys) 41 and recesses (or peaks) 43. The underside surface of flange 23 may be angled somewhat (e.g. 10°) from the horizontal to avoid bubbling if made by a dipping process.

The purpose of this configuration of peaks and valleys, as shown, is to provide sufficient material and, thus, expansion capabilities, with a minimum amount of elasticity, so as to provide an expansion chamber without significant stretching and thinning of the expanding material. While elastic material which thins on stretching could be employed, in certain situations barrier qualities must be maintained, because foodstuffs or the like are carried in the container. In such instances, the barrier properties of the membrane should generally be approximately the same as those required in the bottle walls themselves. Since membrane 9 will usually be thinner than walls 3 (e.g., about 0.015–0.03 inches thick to obtain the necessary relative degree of flexibility over walls 3) further thinning upon expansion may not be tolerable. Thus, in those instances, the illustrated configuration of membrane 9 becomes somewhat important.

Typical barrier properties for membrane 9 where fluid foodstuffs are involved include an oxygen permeability of approximately 1.2 cc-mil/24 hr./100 in.$^2$/atm.; carbon dioxide permeability of approximately 1.9 cc-mil/24 hr./100 in.$^2$/atm.; and water vapor transmission of approximately 4.5 gm-mil/24 hr./100 in.$^2$. Exemplary of the type of material that may be employed as membrane 9 for this purpose includes material similar to that employed in the walls of the container as described above. Other materials may include natural and synthetic rubbers and the like. In either event, while the permeability should be comparable and useful for the intended purpose, particularly by way of satisfying State and Federal packaging laws, it is important that the membrane material be more flexible than the walls of container 3.

The purpose of membrane or diaphragm 9 is to expand sufficiently within container 1 to neutralize any decrease in pressure experienced in container 1 after it is sealed. In order to insure that the external pressure being applied to membrane 9 is the same as that being applied to the external surfaces of walls 3, there is provided in cap 11 an orifice 31. By this technique, if there is a decrease in internal pressure after sealing container 1, the external pressure being experienced on walls 3 is communicated via orifice 31 to the external surface of membrane 9 expanding membrane 9 within container 1, thereby equalizing the pressure therewithin.

The nature of the material employed for membrane 9, the number of convolutions used, the amount of material employed, and the amount or degree of expansion needed, will be controlled by each individual situation, and through simple testing and experimentation, the degree of change in internal pressure experienced for any given situation may be determined and provided for with an adequate margin of safety. For example, simple experimentation of a plastic bottle containing initially hot cooking oil or cranberry juice and the eventual cooling to room or refrigerated temperature may be tested with a membrane 9 of a typical polyethylene, polypropylene or polyvinylchloride employing the standard bottle for the oil or the juice. From this, the depending upon the size of the bottle, the degree of fill in the bottle, the nature of the spout, etc., a membrane from one of the illustrated configurations can be chosen to meet the need and prevent or substantially eliminate inward deformation of the bottle that normally would be experienced. A typical example of full-scale relative dimensions for one bottle configuration is shown in FIG. 1.

Figure 2:
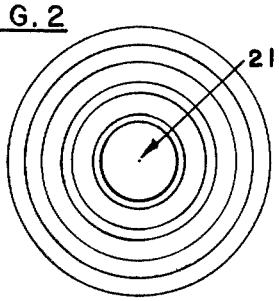
FIG. 2 is a top plan view of one embodiment of a membrane in accordance with this invention.
Figure 3:
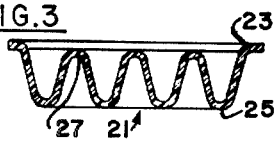
Figure 4:
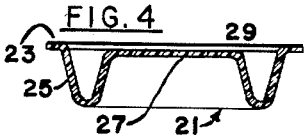
Figure 5:
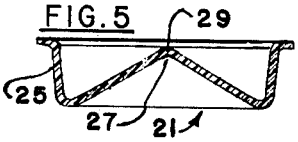
Figure 6:
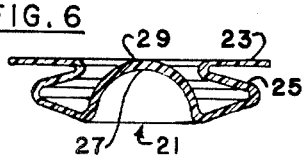
Figure 7:
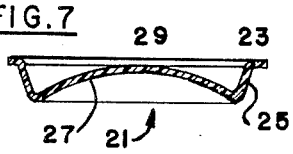
Figure 8:
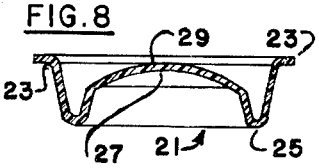
Figure 9:
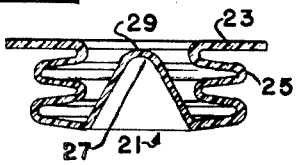
Figure 10:
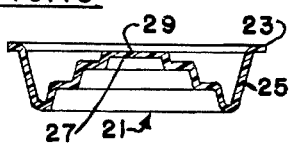
Figure 11:
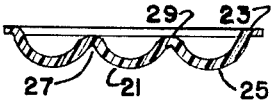

FIGS. 2 and 3 disclose the particular design of membrane 9 employed in FIG. 1. As can be seen, this is a multi-peak convoluted membrane 9 suitable for inward expansion where relatively large amounts of pressure changes are anticipated. FIGS. 4 thru 13 show certain other configurations of this membrane 9. For example, in FIG. 4, there is a plateaued membrane, while in FIG. 5, there is a peaked membrane wherein peak 29 may constitute a single hinge joint for simple expansion. FIGS. 6 and 9 disclose a bellows-type arrangement where there is either one or a plurality of bellows extending in the vertical direction. FIGS. 7 and 8 disclose a simple convex type of arrangement for simple expansion. FIG. 10 discloses a stepped arrangement, while FIG. 11 discloses a cusped arrangement. The star arrangement of FIGS. 12–13 is discussed above.

Additional configurations for the membranes will become apparent to the skilled artisan once given this above detailed disclosure as will many other features, modifications, and improvements. Such other configurations, features, modifications and improvements are, therefore, considered to be a part of this invention, the scope of which is to be determined by the following claims.

I claim:

1. A device for preventing the inward deformation by ambient pressure of a container having a hollow walled dispensing spout and relatively thin flexible walls, after said container is filled and sealed, the device comprising a membrane means for sealing the spout, said membrane means including a circumferentially extending flange and a diaphragm extending downwardly therefrom and more flexible than the walls of the container, means for securing the membrane by said flange into sealing engagement with the spout and means for applying the ambient pressure on the outside surface of the walls of the container to the outside surface of the diaphragm, said diaghragm being formed of a relatively thin and flexible side wall which extends from said spout inwardly of said container when secured therein and which terminates in a bottom wall, said side wall being of substantially uniform thickness and having therein a plurality of longitudinally extending peaks and valleys which extend over a substantial length of said wall thereby to form a cross-section of radial star design, said diaphragm being capable of sufficient lateral expansion by said valleys when pressure is applied to said outside surface of said diaphragm to prevent the deformation by ambient pressure of said container after said container is filled and sealed.

2. A device according to claim 1 wherein the means for securing the membrane into sealing engagement with the spout comprising a cap means which engages the spout and sealingly retains the flange of the diaphragm in contact with the spout.

3. A device according to claim 1 wherein said means for applying the ambient pressure to the outside surface of the membrane means comprises an orifice in the cap means.

4. A device according to claim 1 wherein underside of said flange portion is bevelled with respect to the walls of said flexible portion.

5. The device of claim 1 wherein said radial star design includes four peaks and four valleys.

6. The device of claim 1 wherein said longitudinally extending peaks and valleys extend to said bottom wall such that said bottom wall is of said radial star design.

* * * * *